United States Patent [19]

Alexander et al.

[11] Patent Number: 5,056,290

[45] Date of Patent: Oct. 15, 1991

[54] METHOD, ASSEMBLY AND APPARATUS FOR JOINING PANELS

[75] Inventors: Jack L. Alexander, Danville, Va.; Michael G. Bledsoe, Madison, N.C.

[73] Assignee: AC Corporation, Greensboro, N.C.

[21] Appl. No.: 436,644

[22] Filed: Nov. 15, 1989

[51] Int. Cl.[5] ..... E04C 2/40

[52] U.S. Cl. ..... 52/584; 52/309.3; 52/309.4; 52/309.9; 52/309.11; 52/741

[58] Field of Search ..... 52/579, 580, 581, 584, 52/282, 309.11, 765, 309.3, 309.4, 309.9, 741

[56] References Cited

U.S. PATENT DOCUMENTS

| | | | |
|---|---|---|---|
| 2,394,443 | 2/1946 | Guignon | 52/580 |
| 3,014,561 | 12/1961 | Ratner et al. | 52/581 |
| 3,110,374 | 11/1963 | Valverde | 52/581 |
| 3,512,819 | 5/1970 | Morgan et al. | 287/189.36 |
| 3,640,039 | 2/1972 | McKee et al. | 52/281 |
| 3,685,222 | 8/1972 | Curtess | 52/580 |
| 3,712,005 | 1/1973 | Eschbach et al. | 52/581 |
| 3,729,889 | 5/1973 | Baruzzini | 52/264 |
| 3,744,826 | 7/1973 | Hawes | 52/580 |
| 3,780,481 | 12/1973 | Tomkins | 52/265 |
| 3,972,167 | 8/1976 | Vogeli | 52/481 |
| 4,236,366 | 12/1980 | Rijnders | 52/580 |
| 4,390,578 | 6/1983 | Brooks | 52/309.3 X |
| 4,486,994 | 12/1984 | Fisher et al. | 52/303 |
| 4,691,493 | 9/1987 | Larsen | 52/581 |
| 4,754,587 | 7/1988 | Glaser | 52/282 |
| 4,823,531 | 4/1989 | Labelle | 52/586 |

FOREIGN PATENT DOCUMENTS

| | | | |
|---|---|---|---|
| 2166396 | 5/1979 | Fed. Rep. of Germany | 52/309.9 |
| 2188658 | 10/1987 | United Kingdom | 52/309.4 |

*Primary Examiner*—Richard E. Chilcot, Jr.
*Assistant Examiner*—Deborah M. Ripley
*Attorney, Agent, or Firm*—Ronald P. Kananen

[57] ABSTRACT

Provision is made for an improved method, assembly and a connector apparatus for assembling together a plurality of panels. The connector apparatus includes structure which forms a sealing material reservoir and which can form panel cavities when a panel is seated on the apparatus. The channel type reservoir facilitates the even application of sealant material to the apparatus.

13 Claims, 2 Drawing Sheets

METHOD, ASSEMBLY AND APPARATUS FOR JOINING PANELS

BACKGROUND OF THE INVENTION

The present invention relates to a method, assembly and an apparatus for use in joining together a plurality of separate panels in an expeditious manner which enhances the sealing integrity of the assembled panels.

There are a number of techniques for joining and sealingly connecting structural wall panels together so as to construct a wide variety of prefabricated or field erected partitions and enclosures. Exemplary descriptions of known approaches are set forth in U.S. Pat. Nos.: 3,512,819; 3,640,039; 3,729,889; 3,780,481; 3,972,167; 4,754,587 and 4,823,531.

For instance, air conditioning units utilize a plurality of panels which are joined together to maintain an airtight and fluid-tight compartment which houses air handling components. Typically in such constructions, the panels are made of light-weight insulated material and are joined together along their longitudinal edges by connector apparatus. Since air conditioning equipment housings typically operate at either a positive or negative atmospheric pressure, it is necessary to provide some type of seal to prevent not only air but moisture leakage as well through the joints between the adjacent panels.

Many attempts have been made for ensuring the sealing of such joints. Generally, such sealing is effected by applying a sealing material to the connector apparatus along the junction lines between it and the panel members. While this approach has served adequately, nevertheless there are ongoing attempts to improve upon airtight and watertight seals, especially with the newer types of air conditioning units which use significantly higher differential pressures that tend to worsen air and moisture leakage problems.

Another known approach for joining insulated panels is described in FIG. 1 which illustrates a reinforced H-member 1 having a pair of separate insulating panels 2 joined thereto. Each panel 2 is received between a pair of flange members 3 which have inwardly turned ridges or stops 4 upon which are seated edges of the panels 2. A suitable flowable sealant material, for example, caulking (not shown) is applied to the stops which contact panel edges to provide for a seal against moisture and air leakage. While such an approach serves adequately, there are nevertheless shortcomings with the sealing, such as the sealant migrating to voids in the connector apparatus away from the stops as well as the joints being susceptible to rivers of fluid (i.e., air with entrained moisture) causing sweating of the joints. Moreover, such leakage causes some pressure drop which over, for example, a 200 foot unit becomes significant. Thus, there is a continuing need to provide for an even more effective air and moisture barrier as well as a desire to further enhance the ease and reliability of applying the sealant material to the connector apparatus.

SUMMARY OF THE INVENTION

According to one aspect of the present invention, provision is made for a connector apparatus for use in assembling panels. Essentially, the connector apparatus comprises at least a pair of generally parallel and spaced apart flange members and a web assembly interconnecting the flange members. Provision is made for protruding means for securely gripping an edge of the panel when the panel is inserted between the flange members and for forming at least a sealant reservoir for sealant material which seals the panel edge when the panel is seated thereagainst. When sealant is in the reservoir and cavity there is provided improved air and moisture barrier.

In another illustrated embodiment, the protruding means forms a panel cavity upon seating of the panel thereon for reception of overflow sealant so as to thereby form an air and moisture barrier.

In another illustrated embodiment of the present invention, provision is made for a joint assembly for use in assembling together a plurality of panels. The joint assembly includes a connector apparatus of the type noted above which includes at least first and second pairs of generally parallel and spaced apart flange members and a corresponding web assembly for each pair so that individual panels can be inserted between respective pairs of flange members. The connector apparatus includes protruding means for gripping respective edges of a panel when the panel is inserted and for forming a sealant reservoir. When the panel is seated on the protruding means there is formed a panel cavity. The assembly includes a hardenable sealant material which is flowable in the reservoir and into the cavity when the panel is inserted for providing enhanced watertight and airtight barriers.

According to this invention, there is provided a method of assembling a plurality of panels together comprising a step of providing a connector apparatus adapted for securing a plurality of panels thereto wherein the connector apparatus is provided with at least first and second pairs of spaced apart and generally parallel flange members and a web assembly interconnecting each of the pairs of flange members; wherein the step of providing a connector apparatus includes a step of providing protruding means for locking an edge of a respective panel seated thereon and for providing a sealant reservoir and for causing the formation of at least a sealant cavity in the panel as the panel is seated on the protruding means, and a step of providing a hardenable sealant material to the connector apparatus so that the material can enter the reservoir and panel cavity and thereby provide effective barriers against air and moisture leakage.

Among the other objects and features of the present invention are the provisions of an improved method, assembly and apparatus for use in joining together a plurality of panels; the provisions of an improved method, assembly and apparatus which enhance the effectiveness of air and watertight sealing; the provisions of an improved method, system and apparatus for enhancing the ease of applying sealant material to the apparatus; the provisions of an improved method, assembly and apparatus which enhance the securing capabilities of a connector member relative to wall panels; the provisions of an improved method, system and apparatus which enhance the structural integrity of the panel of a wall assembly so as to make for a quieter assembly.

Still other objects and further scope of applicability of the present invention will become apparent from the detailed description to follow when taken in conjunction with the accompanying drawings in which like parts are designated by like reference numerals throughout the several views.

DETAILED DESCRIPTION

Figure 2:
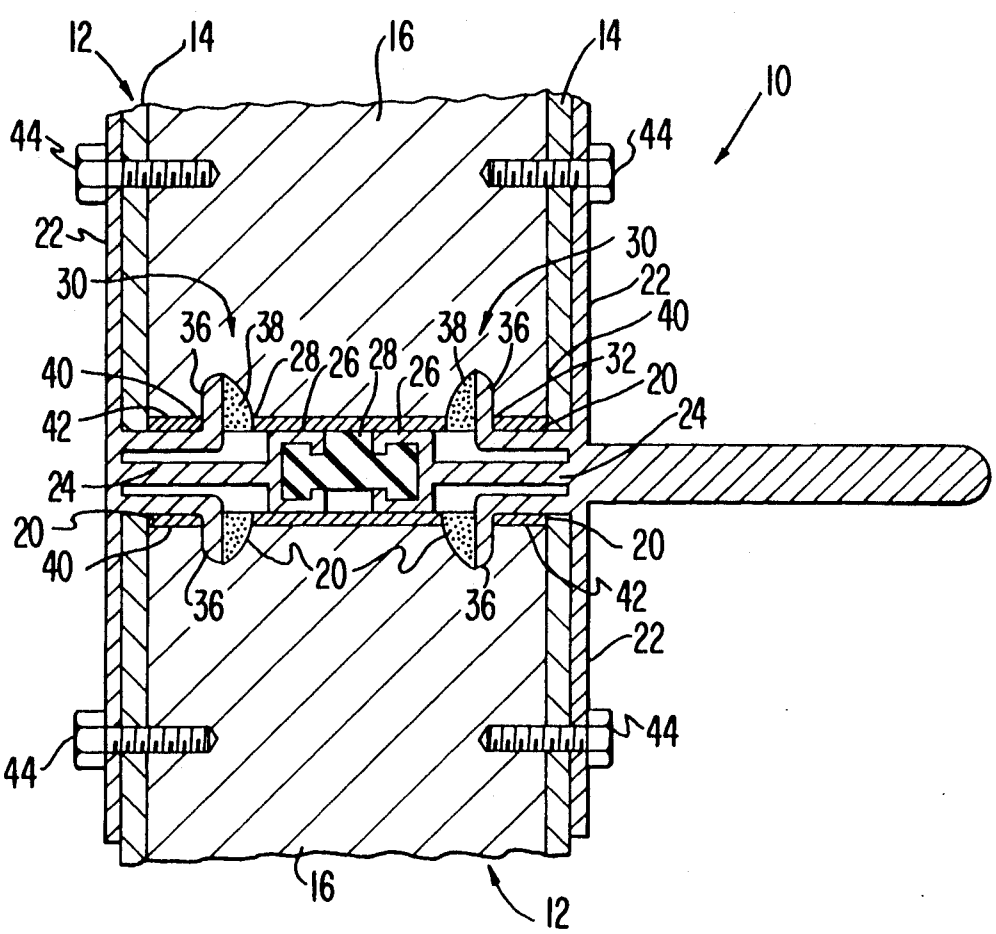
FIG. 2 is a cross-sectional view of a joint assembly made in accordance with the principles of the present invention.
Figure 1:
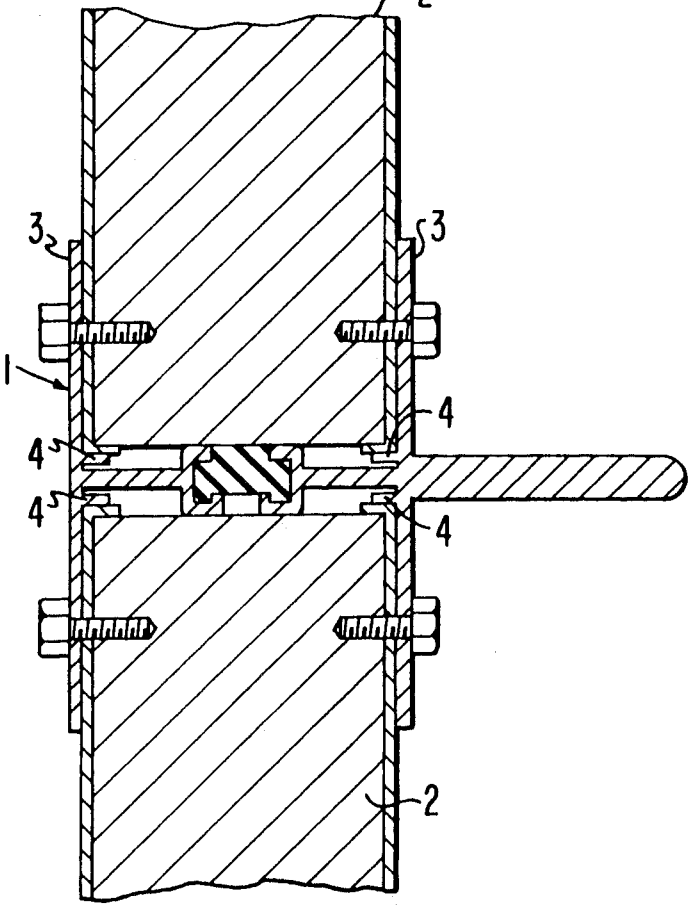
FIG. 1 (PRIOR ART)
FIG. 1 is a cross-sectional view of a prior art joint assembly.
Figure 3:
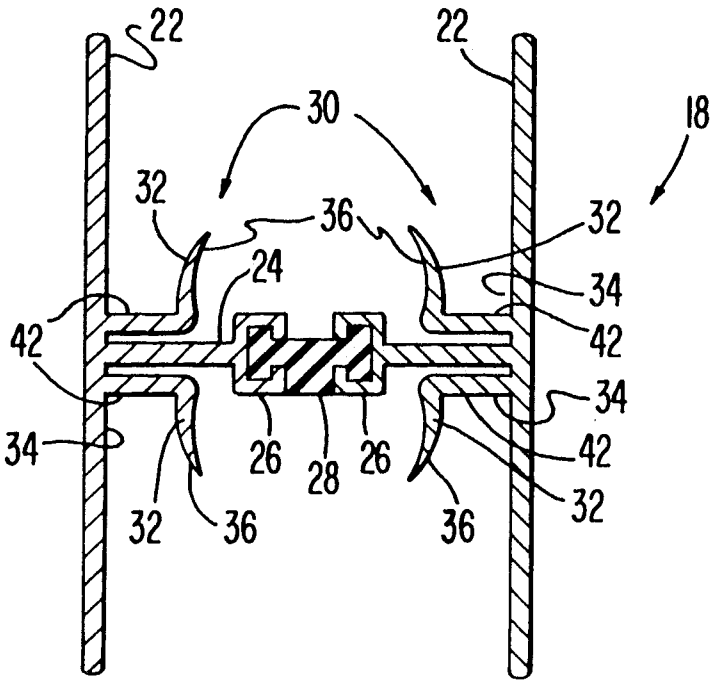
FIG. 3 is a cross-sectional view of one embodiment of a connector apparatus of the present invention; and, FIG. 4 is a cross-sectional view of another embodiment of a connector apparatus of the present invention.

Reference is made to FIGS. 2 and 3 for depicting one preferred embodiment of an improved joint assembly 10 of the present invention which is utilized to join together a plurality of building wall panels 12 to form a partition or enclosure (not shown).

In this embodiment, there is depicted a pair of insulated building wall panels 12 having exterior and generally parallel outer layers or faces 14 on opposite sides of a central insulating core 16. The core 16 is adhesively bonded to the inner surfaces of the outer panel faces 14. The panels 12 will be described briefly since they do not, per se, form an aspect of the present invention. The panels 12 are to be used, for instance, in the construction of insulated wall panels for air conditioning enclosures or the like. The panel faces 14 can be formed of any conventional building material, such as thin-gaged metal or the like and in this embodiment is made of sheet metal. The core 16 is made of a suitable insulating building plastic material. However, the core 16 can be practically any kind of suitable material used. These panels 12 are relatively light-weight for ease in handling and have requisite thermal insulating properties with sufficient structural strength for the purposes intended. Moreover, it is desired that the core 16 should be able to be compressed when it cooperates with an improved connector apparatus 18 in a manner which will be described so as to form a panel cavity.

In this particular embodiment, the joint assembly 10 comprises the connector apparatus 18 and a suitable hardenable sealant material 20 (FIG. 2), such as caulking. The connector apparatus 18 is a reinforced H-type connector having a length of about 25 feet and a width sufficient to accommodate a two-inch panel. The reinforced connector apparatus 18 can be made of any suitable material and, in this embodiment, is made of extruded aluminum.

When the caulking 20 sets, it provides an air and watertight seal between the panels 12 and the connector apparatus 18. The sealant can also be made of other suitable hardenable materials, such as silicone and acrylic. These kinds of sealing materials are applied by conventional approaches.

Continued reference is made to FIGS. 2 and 3 for describing the connector apparatus 18. The connector apparatus 18 includes pairs of oppositely extending flange members 22 which are generally spaced apart from each other by a distance sufficient to snugly accommodate the longitudinal edges of the respective panels 12. A pair of central web members 24 having enlarged and generally U-shaped distal ends 26 are arranged to have received therebetween a thermal block 28. The thermal block 28 is fabricated from a suitable phenolic plastic, but can be made of other suitable materials capable providing the thermal insulation desired. Essentially, the thermal block 28 serves as an insulating bridge so that the web members 24 do not allow transfer of heat from one side of the panel 12 to the other.

In accordance with this invention, provision is made for protruding means 30 for securely mounting thereon the edges of the insulating panel 12. The protruding means 30 includes a pair of spaced apart and generally upstanding stop or protruding members 32 which are arranged to provide, in conjunction with the flanges 22, sealant reservoirs 34. By virtue of the structure of the connector apparatus 18 the reservoirs 34 define elongated tracks into which the caulking 20 is applied before the panel 12 is seated thereon. When the caulking 20 is applied it will tend to remain on the track but, of course, some caulking will flow into the cavity to create moisture and air barriers during the seating process. By virtue of the sealant reservoirs 34, it will be appreciated that a panel assembly operator can easily apply sealant to the connector apparatus 18 without much sealant being lost due to sealant flowing from the desired areas of the connector. This enhances the informity of the resulting sealing engagement between the panels and the connector, especially along the length of the connector 18, which as noted, can be about 25 feet in length.

The protruding members 32 have upwardly extending distal end portions 36. In this embodiment, the distal end portion 36 are curved inwardly slightly away from the flanges 22 and will, upon penetration into the core 16, create corresponding panel sealant cavities 38, as shown in FIG. 2, by compressing the core 16. Accordingly, excess caulking 20 in the reservoirs 34 can at least partially fill the panel cavities 38 and thereby, upon sealant curing, provide for significant moisture and air barriers in addition to the air and moisture sealing provided by the caulking 20 between a panel edge 40 and a sealing surfaces 42 on the protruding members 32.

While this embodiment discloses curved distal end portions 36, such portions need not be curved, but can be straight and tapered. The invention contemplates that the configuration of the distal end portions 36 can be varied so long as their configurations can penetrate into the core 16 and, preferably form, corresponding cavities 38 so as to serve as air and moisture barriers when the sealant enters and cures therein. Additionally, the protruding members 32 serve to lock the panels 12 in place so as to even better secure the panels 12 to the connector apparatus 18. This has the advantage of enhancing noise control by minimizing vibrational displacement of the panel 12. Of course, as is known, conventional screw-type fasteners 44 act to secure the panels 12 to the connector apparatus 18.

Figure 4:
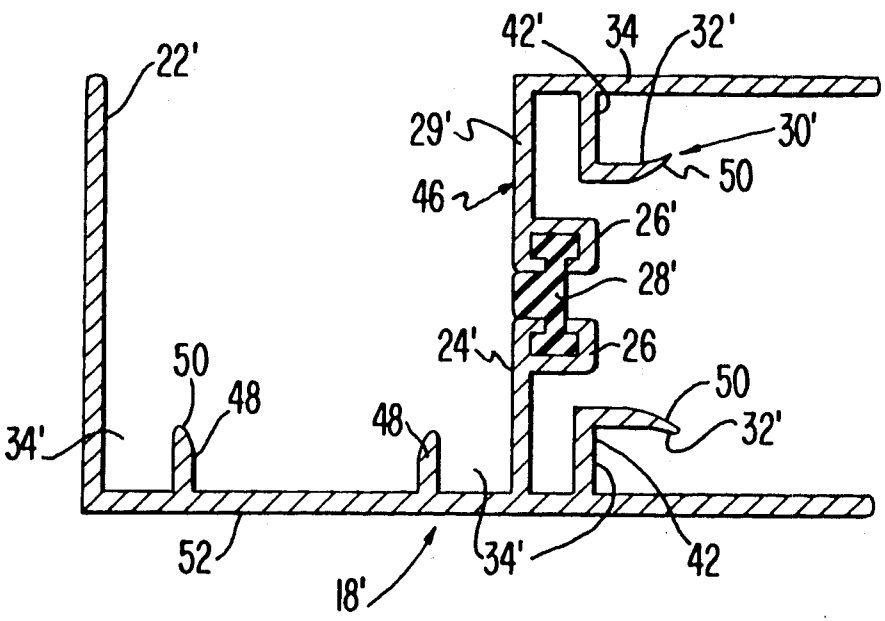

Reference is now made to FIG. 4 for illustrating another embodiment of a connector apparatus 18'. Structure of this embodiment, which is like that of the other embodiment will be designated by like reference numerals with, however, the addition of a prime marking. In this embodiment, the connector apparatus 18' is a W-shaped connector and the web members 24' form, in effect a flange 46 which cooperates with another flange 22'. The protruding means of this embodiment includes a pair of upstanding protruding members 32' and 48. The protruding members 32' are like that of the previous embodiment, except that the distal end portions 50 are straight and tapered. Such a configuration assists in its penetration into the core 16 to assist in the stability of the assembled panels (not shown). Also, the protruding members 48 extend from connecting web 52 as opposed to extending inwardly from the flanges.

It will be appreciated that the principles of the present invention encompass achieving the advantages noted above for other configured connectors such as U-shaped, etc. Also, the method of assembling the panels together is apparent from the above description.

According to the present invention it will be recognized that certain changes may be made in the above-described construction and method without departing from the scope of the present invention herein involved. It is intended that all matter contained in this description and shown in the accompanying drawings shall be interpreted as illustrative and not in any limiting sense.

What is claimed is:

1. A connector apparatus for use in securing at least a panel thereto, said connector apparatus comprising:

at least a first pair of generally parallel and spaced apart flange members, a web assembly interconnecting said first pair of flange members and defining a first space with said first pair of flange members which is adapted to receive therein a panel:

first protruding means for gripping an edge of the panel when the panel is inserted between said first pair of flange members in said first space and for defining at least a first sealant reservoir for sealant material which seals the panel edge when the pane edge is seated thereagainst.

2. The connector apparatus of claim 1 wherein said first protruding means forms at least a first panel cavity when the panel is seated on said first protruding means.

3. The connector apparatus of claim 1 wherein there is provided a second pair of generally parallel and spaced apart flange members extending in another direction from said web assembly and defining a second space which is adapted to receive therein a second panel, and second protruding means for gripping an edge of the second panel and defining at least a second sealant reservoir for sealant material which seals the panel edge of the second panel when the second panel is seated on said second protruding means.

4. The connector apparatus of claim 3 wherein said first and second protruding means includes at least a pair of spaced apart protruding members, each being adjacent a respective one of said flange members for defining a corresponding one of said sealant reservoirs.

5. The connector apparatus of claim 4 wherein each of said protruding members includes a curved distal end portion which forms a panel cavity upon seating of the panel thereagainst by compressing by panel.

6. The connector apparatus of claim 5 wherein said first and second sealant reservoirs are elongated and define corresponding elongated sealant tracks into which the sealant material is easily applied.

7. A joint assembly for use in assembling together a plurality of panels, said assembly comprising:

a connector apparatus adapted for securing at least a panel thereto, said connector apparatus comprising a first pair of generally parallel and spaced apart flange members, a web assembly interconnecting said first pair of flange members and defining a first spaced for receiving a panel;

first protruding means for gripping an edge of the panel and for defining a first sealant reservoir for sealant material which seals the panel edge when the panel edge is seated thereagainst, and, hardenable sealant means flowable in said reservoir so as to enhance a watertight and airtight seal.

8. The assembly of claim 1 wherein said first protruding means forms panel cavities when the panels are seated on said first protruding means so as to receive sealant material therein.

9. The assembly of claim 8 wherein there is provided a second pair of generally parallel and spaced apart flange members extending in another direction from said web assembly and defining a second space which is adapted to receive therein a second panel, and second protruding means for gripping an edge of the second panel and defining at least a second sealant reservoir for sealant material which seals the second panel edge when the second panel is seated on said second protruding means.

10. The assembly of claim 7 wherein said first and second protruding means includes at least a pair of spaced apart protruding members, each one being adjacent a respective one of said flange members for defining in part a corresponding one of said sealant reservoirs.

11. The assembly of claim 4 wherein each of said protruding members includes a curved distal end portion which forms a panel cavity upon seating of the panel thereagainst.

12. The assembly of claim 5 wherein said first and second sealant reservoirs are elongated and define corresponding elongated sealant tracks into which the sealant material is easily applied.

13. A method of joining together a plurality of panels comprising the steps of:

providing a connector apparatus adapted for securing a plurality of panels thereto;

providing a plurality of panels adapted to be secured to the connector apparatus;

providing the connector apparatus with pairs of generally parallel and spaced apart flange members having a web assembly interconnecting the respective ones of said pairs of flange members and being arranged so that an edge of the panel can be inserted in a space between each of said pair flange members and protruding means in said spaces for gripping an edge of a respective panel which is seated thereon and defining at least a sealant reservoir for sealant material which seals the panel edge when the panel is seated thereon;

preliminarily applying a hardenable sealant in said sealant reservoirs; and, inserting respective ones of the panels into said spaces between appropriate ones of the pairs of flange members so that each panel is seated on the reservoir and said protruding means.

* * * * *